United States Patent [19]

Smolderen

[11] 4,093,069

[45] June 6, 1978

[54] PACKAGE FOR A STACK OF SHEET MATERIALS

[75] Inventor: Albert Emiel Smolderen, Aartselaar, Belgium

[73] Assignee: AGFA-GEVAERT N.V., Mortsel, Belgium

[21] Appl. No.: 674,150

[22] Filed: Apr. 6, 1976

Related U.S. Application Data

[63] Continuation of Ser. No. 530,028, Dec. 4, 1974, abandoned.

[30] Foreign Application Priority Data

Dec. 7, 1973 United Kingdom ..... 56848/73

[51] Int. Cl.[2] ..... B65D 65/16; B65D 75/28

[52] U.S. Cl. ..... 206/455; 206/606; 229/87 R

[58] Field of Search ..... 206/455, 557, 555, 451, 206/498; 229/87 B, 87 R, 17 S

[56] References Cited

U.S. PATENT DOCUMENTS

| | | | |
|---|---|---|---|
| 2,296,951 | 9/1942 | Rosen et al. | 229/87 B |
| 2,327,713 | 8/1943 | Hunter | 206/455 |
| 3,443,093 | 5/1969 | Lindenmuth et al. | 206/455 |

*Primary Examiner*—William T. Dixson, Jr.
*Attorney, Agent, or Firm*—William J. Daniel

[57] ABSTRACT

A package for packaging a stack of articles in sheet form comprises at least two strips which are overlappingly sealed to each other, so forming a loosely overlying edge which greatly facilitates opening of the package. The whole may be provided with protective sheets at both sides of the stack, whereby said protective sheets may have a row of perforations at the edge of the composing strips so that the first sheet of the stack may easily be taken from the stack after removing part of the protective sheets.

2 Claims, 10 Drawing Figures

PACKAGE FOR A STACK OF SHEET MATERIALS

This is a continuation of Ser. No. 530,028, filed Dec. 4, 1974, now abandoned.

This invention is concerned with a package, and more particularly with a package intended for containing a stack of sheet materials. The invention reveals itself extremely well suited for containing a stack of sensitized films in face to face relationship, although any stack of sheet materials and, if necessary, even individual sheets may be contained in a package according to the invention.

Compared to the prior art packages, the package according to the invention has significant advantages, whereof the feature of easy opening is one of great importance.

Moreover, the package may be easily manufactured and contributes positively to a clean aspect when being definitely open.

The prior art packages, for example the one described in Belgian Patent Specificaton No. 774,378 filed Oct. 22, 1971 by Agfa-Gevaert N.V. wherein use is made of a tear-strip provided at the inner side of the package, suffer from a first drawback in that the exact positioning of said tear-strip in the package and the punching of said strip through the latter at well defined distances requires very complicate pckaging apparatus.

The second drawback is noticed at the moment of use, that is to say, when the package is opened by means of tearing said strip. In that case, the latter becomes the cause that uneven and frayed edges are formed which give rise to an untidy appearance of the whole.

It is an object of the invention to provide a package which does not possess the foregoing disadvantages.

According to the present invention there is provided a package for packing a stack of materials in sheet form, comprising :

a first strip of sealable material enclosing a first part of said stack a second strip of sealable material enclosing the other part of said stack, said first and said second strip being sealed together in such a way that the edges of one of said strips are overlappingly sealed to the edges of the other one in order to form a tube having a loosely overlying edge and a seal at both residual edges of said stack in order to close said tube hermetically.

As will hereafter be expalined each or either of the fist and second strips referred to in the foregoing definition may itself be a composite strip formed by two or more narrower strips of material sealed togehter in marginally overlapping relationship. Accordingly the invention includes any package comprising a stack of sheets in an enveloping wrapper, said wrapper comprising strips of material sealed together in marginally overlapping relationship and forming a tube within which the stack is located, the ends of the tube having been sealed up so that the stack is totally enclosed, there being, across opposite faces of the stack, marginal portions belonging to one or more of said strips, which are free, i.e. unattached to the underlying strip portions which they overlap, so that a section of the wrapper, enclosing a part of the stack, may be removed by pulling on said marginal portions to break the seals between that section of the wrapper and the remainder of it.

The scope and spirit of the invention will best be exemplified by a description of a preferred embodiment and in the light of the accompanying drawings, in which.

Figures 1, 2, 3A, 3B, 4:
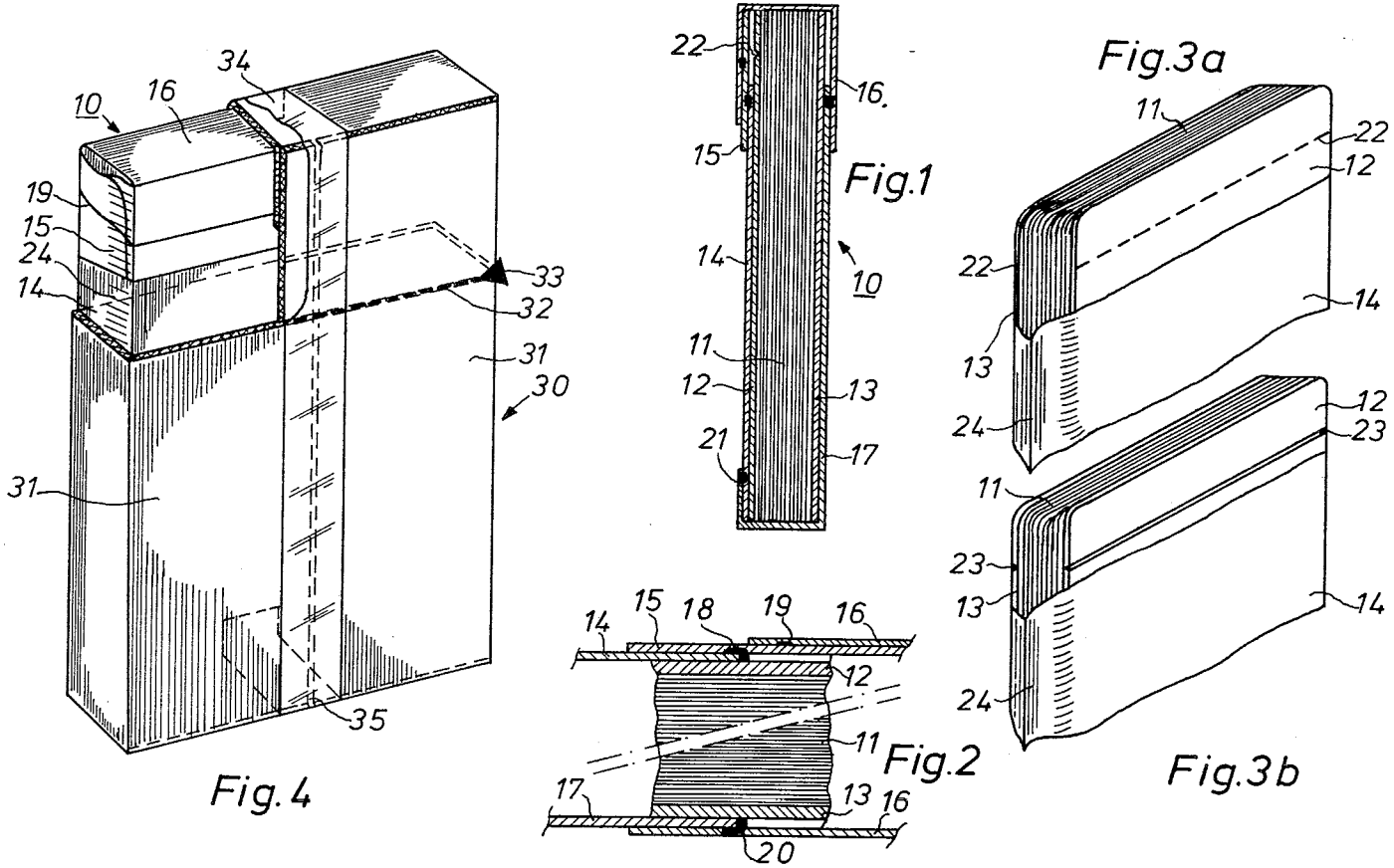
FIG. 1 is a cross-sectional view of a package according to the invention.
FIG. 2 is an enlarged view of FIG. 1 in order to show the seals between the composing strips.
Figure 8A:
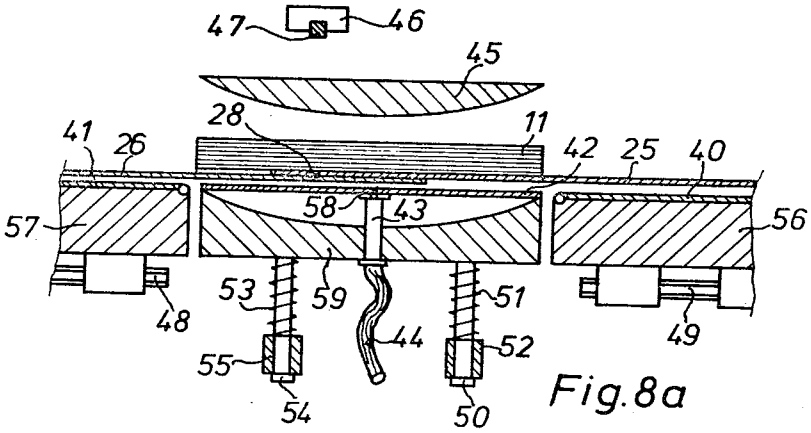
Figure 8B:
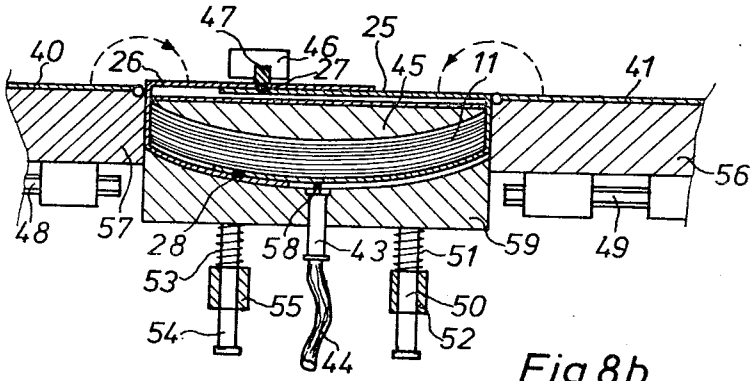
Figure 6:
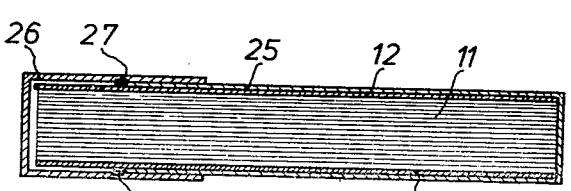
Figure 7:
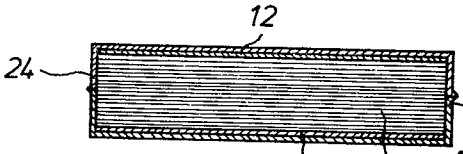
Figure 5:
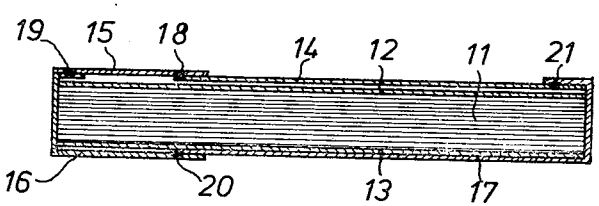

FIG. 3*a* and 3*b* show details of the protective sheets of the stack to be packed;

FIG. 4 is an isometric view of a combined package enclosing a package according to the invention;

FIG. 5 shows a longitudinal cross-section of another package according to the invention;

FIG. 6 is a longitudinal cross-section of still another package according to the invention;

FIG. 7 is a transversal cross-section of the packages of FIG. 1, 5 and 6;

FIGS. 8*a* and 8*b* show an elementary apparatus for packing a stack of sheet materials in a package according to FIG. 6.

According to FIG. 1, a package 10 is provided, intended for containing a stack of sheet materials 11. Optionally, but not necessary, is the provision of a pair of protective covers 12 and 13, one cover situated at each side of the stack 11 and overlapping the sheets contained in said stack. The stack is hermetically sealed by means of a wrap, comprising the strips 14, 15, 16 and 17. Said strips are made of materials which can be sealed together. This sealing may be carried out by glueing, heat sealing or any other technique known in the art. In the case that the wrap has to contain sheets of light-sensitive material, such as photographic sheet film, the constituting materials must be light- and moisture-proof and be capable of protecting the contained sheets against chemical vapours. A paper-, aluminium-polyethylene laminate suits this purpose very well. Moreover, by the fact that this material is easily heat sealable, automizing the packaging process may be carried out with apparatus which is rather simply in design. At the front side of the stack 11 are positioned a first broad strip 14 and a first narrow strip 15 which are overlappingly secured to each other with the help of a seal 18 (see also FIG. 2). The seal 18 is situated at one edge of the broad strip 14, but the narrow strip 15 extends partly over said edge and is loosely overlying. The reason therefore will be explained in the course of this description. The width of the composite strip, formed by the sealed broad and narrow strips 14 and 15 is euqal to one dimension of the stack of sheets to be packed and the composite strip is preferably longer than the other dimension of the stack. In a preferred embodiment the strips 14 and 15 are therefore delivered in web form and may already have been previously sealed together prior to the packaging step.

At the back side of the stack 11, a more or less analogous combined strip is provided but it is characterized in that it is broader than the first one.

Indeed, said second combined strip — which is preferably delivered in web form too — will serve to enclose partially the whole stack 11 and must therefore have a width substantially larger than the same one dimension of the stack plus twice the thickness of the stack.

The composing strips 16 and 17 are sealed together in the same way as the strips 14 and 15. The seal 20 is provided at the edge of the broad strip 17, and the narrow strip 16 is overlappingly sealed to the broad strip 17.

Both combined strips are placed in correct position relative to the stack 11 by locating them as that the edges of the broad strips 14 and 17 which are overlapped by the narrower strips 15 and 16 are at substantially the same distance from an edge of the stack 11. Then, the projecting lengths of the combined strip formed by the strips 16 and 17 are folded over the stack and sealed to the combined strip formed by the strips 14 and 15, the seals thus formed being indicated at 19 and 21.

In this way a kind of tube is obtained in which the stack 11 and its optional protective covers 12 and 13 are enclosed. By forming another seal 24 between the projecting portions of the composite strips along the other edges of the stack 11, this tube becomes hermetically closed, and an air-tight, moisture-proof wrap is thus provided around the stack 11. When the stack is provided with protective covers 12 and 13, made of a relatively stiff high-quality cardboard, the seal 18 may even be formed over a grater area in order to fix both strips 14 and 15 to protective cover 12.

By the fact that the narrow strips 15 and 16 are sealed to the broad strips 14 and 17 respectively, in overlapping relationship thereto, and so as to leave the overlapping margins of the narrower strips at least partly free, these free marginal portions of the narrower strips provide hand holds by which the said strips can be gripped and torn off in order to open the wrapper. When the package is thus opened, the opened package has a clean and tidy apperance (see FIGS. 3*a* and 3*b*). In order to improve the convenience of the package, at least one of the protective covers may be provided with a zone of less mechanical strength such as a row of perforations 22 or an incision 23 of about half the thickness of the protective cover 12 (FIG. 3*a* and 3*b*). This enables the operator, after having opened the wrap, to remove part of one of the protective covers 12 or 13, in order to facilitate removal of the first sheet of the stack 11 from the wrap. This feature too, is a remarkable advantage of the package according to the invention, because taking the first sheet of a slightly compressed stack is often rather difficult. The provision of a partly free face at one upper margin of said first sheet permits the operator slightly to flex the latter, so that it can easily be taken between the thumb and the index of the hand.

The wrap, containing the stack of sheet materials may be placed in a box or enveloped in a supplementary wrapper, made e.g. of corrugated cardboard. An example of such combined package is illustrated in FIG. 4.

Said combined package 30 comprises a corrugated cardboard sheet punched out in a form capable of enclosing the wrapped package. The small slot 35 corresponding with the ends of the flaps 31 is sealed by means of a self adhesive tape 34. In this way the package 10 is safely enclosed. In order to facilitate the opening of the cardboard envelope, a tear-strip and/or a row of perforations 32 may be provided, wherein tearing or breaking the perforations is performed by pulling the tab 33.

FIG. 5 represents a longitudinal cross-sectional view of a package which is more or less analogous to the package illustrated in FIG. 1. The main difference between the packages resides in the fact that the narrow strip 15 extends over the strips 14 and 16 and forms the link between both latter strips. This set-up results in an economy of packing material, because the strip 16 may be narrower than in the case illustrated in FIG. 1.

FIG. 6 represents the most simple embodiment of a package according to the invention. Instead of four, only two strips of packing material, 25 and 26, are required and two seals, 27 and 28, suffice for sealing them together. The apparatus, capable of packing a stack in such an envelope may be kept relatively simple. A schematic view of such apparatus is represented in FIGS. 8*a* and 8*b*.

A tansverse cross-sectional view of a package according to the invention is given in FIG. 7 to illustrate the longitudinal seal 24 which is required along the side edges of the stack in order to close the tube formed by the transverse sealing of two or four strips of packing material.

FIGS. 8*a* and 8*b* are views of the packing steps in order to enclose a stack of sheet materials into a package according to FIG. 6.

In the apparatus two strips 25 and 26 are treated which have already been sealed together with the help of the seal 28. Both webs may be continuously delivered in web-form from a previous manufacturing station (not represented).

The stack 11 is positioned on the sealed webs 25 and 26 in such a way that the relative positions between the seal 28 and its associated loosely overlying edge have already been situated in the exact order. To prevent a shifting of the webs, a kind of diaphragm in the form of a flexible perforated metallic sheet 42 is provided, the perforations 58 thereof being connected with the pipe 43, communicating with a vacuum source (not shown) by means of a suitable flexible conduit 44. The pipe 43 is capable of moving in axial direction through a concave member 59. This concave member 59 itself is yieldingly supported by means of springs 51 and 53, which enclose supporting members 50 and 54 respectively, which are capable of performing an axial sliding movement in their respective bushes 52 and 55. At either side of the concave member 59 are provided slideable supports 56 and 57, which are capable of sliding under the influence of the force, exerted by the piston rods 48 and 49, which are secured to said supports with the help of solid blocks.

Above the concave member 59 a convexly shaped pressure member 45 is fitted, which may undergo a vertical movement in order to press on the stack of sheets 11. At the uppermost level is situated a heat-sealing electrode 47 built-in into a support 46. Preferably, the heat-sealing electrode may be made of TEFLON material (registered trade-mark of E.S. Dupont de Nemours — Wilmington, Del. U.S.A.).

At their upper side the slideable supports 56 and 57 bear the hinge leaves 40 and 41 respectively, which are capable of performing a partial rotation of 180° around their axes, the latter being situated in close proximity of the side edges of the concave member 59.

When the heat-sealing step has to be carried out, the convexly shaped pressure member 45 is pushed in downward direction and urges against the stack 11, which is flexed in order to conform to the curvature of the concave member 59. Upon further pushing, the member 59 itself starts lowering, so that the level of the upper face of the pressure member 45 coincides with the plane of the hinge leaves 40 and 41. At that moment, aid hinges perform a 180 degrees rotation, whilst folding the strips 25 and 26 around the stack 11. Subsequently, air motors (not shown) are energized and urge the slideable supports 56 and 57 against the side edges of the stack 11 which becomes completely immobile in this way. In the meantime a heat seal 27 (FIG. 6) is formed by the sealing electrode 47 which too has performed a vertical downward movement in order to contact the strips 25 and 26. A tube of heat-sealable material is in this way laid around the stack 11.

Upon further moving the slideable suppots 56 and 57 against the stack 11, the latter is further bent and the tube no longer closely fits around the stack. This permits to retract the convexly shaped pressure member 45 out of the tube, whereinafter the air motors are de-energized, enabling the slideable supports 56 and 57 to withdraw and to tension the stack 11 in its enclosure again, thereby to hermetically close this partial package in a further sealing step (not represented).

From the foregoing, it may be concluded that a new and useful kind of package has been deviced which shows the advantage of being easy to open, while maintaining a neat apperance when opened. Although the description of some preferred embodiments was directed to a package comprising materials capable of being heat-sealed, this feature is however not limitative for the scope and spirit of the invention which shall be derived from the appended statements.

I claim:

1. A package for a stack of generally quadrangular sheet materials whic is adapted to be opened at one end to leave a defined edge around said opening, which package comprises a composite wrapper of flexible wrapping material having a width slightly exceeding the width plus twice the thickness of said stack and an overall length exceeding twice the length and twice the thickness of said stack, said wrapper including at least one body sheet extending around one end and the major lengthwise portion of the opposite exterior surfaces of said stack but terminating at both end edges short of the other stack end, at least one end sheet extending around said other stack end and over the remaining lengthwise portions of said exterior surfaces with its edge margins in overlapping relation with the edge margins of said body sheet, a seal detachably adhering each end of said body sheet in the vicinity of the edge threof to a locus of the contiguous face of the end sheet spaced from the corresponding end edge of said end sheet, said composite wrapper being uniformly tensioned around the stack periphery in its lengthwise direction, whereby said stack is tightly contained within a tube defined by the thus sealed composite wrapper, and means for sealing the opposite ends of said tube along the sides of said stack.

2. The package of claim 1 wherein said sheet material stack includes exterior protective covers of stiff material and the end edges of said body sheet are sealed to contiguous portions of said covers as well as to said end sheet margins.

* * * * *